US010449765B2

(12) United States Patent
Tomimatsu et al.

(10) Patent No.: US 10,449,765 B2
(45) Date of Patent: Oct. 22, 2019

(54) LIQUID EJECTING HEAD AND LIQUID EJECTING APPARATUS

(71) Applicant: SEIKO EPSON CORPORATION, Tokyo (JP)

(72) Inventors: Shingo Tomimatsu, Matsumoto (JP); Shunsuke Watanabe, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/913,119

(22) Filed: Mar. 6, 2018

(65) Prior Publication Data

US 2018/0264816 A1 Sep. 20, 2018

(30) Foreign Application Priority Data

Mar. 17, 2017 (JP) ..... 2017-052102

(51) Int. Cl.
*B41J 2/14* (2006.01)

(52) U.S. Cl.
CPC .. *B41J 2/14233* (2013.01); *B41J 2002/14241* (2013.01); *B41J 2002/14266* (2013.01); *B41J 2002/14419* (2013.01); *B41J 2002/14491* (2013.01)

(58) Field of Classification Search
CPC ..... B41J 2/14233; B41J 2002/14491; B41J 2002/14266; B41J 2002/14419
See application file for complete search history.

(56) References Cited

U.S. PATENT DOCUMENTS

2011/0205270 A1 8/2011 Miyata
2018/0141336 A1* 5/2018 Kida ..... B41J 2/14233

FOREIGN PATENT DOCUMENTS

JP 2011-167956 A 9/2011

* cited by examiner

*Primary Examiner* — Lamson D Nguyen
(74) *Attorney, Agent, or Firm* — Workman Nydegger

(57) ABSTRACT

A liquid ejecting head includes a liquid ejection unit, a flexible substrate, and a case member. The liquid ejection unit includes a drive element, a pressure chamber, and a nozzle. The flexible substrate is electrically connected to the drive element. The case member includes a flow channel configured to supply the liquid to the pressure chamber and an opening portion through which the flexible substrate is inserted. The flexible substrate has a straight portion and a wide portion having a width more than that of the straight portion. The case member has a side wall surrounding the opening portion, and a cutout portion formed in the side wall and configured to release the opening portion outward from the side wall. Portions of the side wall across the cutout portion are positioned outside the straight portion of the flexible substrate disposed in the opening portion.

20 Claims, 13 Drawing Sheets

LIQUID EJECTING HEAD AND LIQUID EJECTING APPARATUS

The entire disclosure of Japanese Patent Application No. 2017-052102, filed Mar. 17, 2017 is expressly incorporated by reference herein.

BACKGROUND

1. Technical Field

The present invention relates to a technique for ejecting a liquid such as ink.

2. Related Art

Liquid ejecting heads for ejecting liquid such as ink from a plurality of nozzles have been proposed. For example, JP-A-2011-167956 discloses a liquid ejecting head in which a liquid stored in a liquid storage chamber (a common liquid chamber) is supplied to a plurality of pressure chambers and the pressure in each pressure chamber is changed by drive elements such as piezoelectric elements to eject the liquid from nozzles. In the technique of JP-A-2011-167956, the liquid storage chamber is formed in a case member (a unit case), the case member is provided with an opening portion entirely and circumferentially surrounded by a side wall, and a flexible substrate (a flexible cable) is inserted through the opening portion electrically connected to the drive elements.

However, in a configuration in which a flexible substrate is inserted through an opening portion entirely and circumferentially surrounded by a side wall, as in JP-A-2011-167956, in order to reduce the size of a liquid ejecting head, the width of the opening portion needs to be reduced, and thus the width of the flexible substrate also needs to be reduced to fit the size of the opening portion. When the width of the flexible substrate is, however, reduced, wiring width is also reduced, resulting in generating more heat. In contrast, when the wiring width of the flexible substrate is increased to suppress heat generation, the width of the opening portion needs to be increased, and the size of the liquid ejecting head is increased. As described above, in the configuration disclosed in JP-A-2011-167956, a reduction in the size of the liquid ejecting head and an increase in the wiring width of the flexible substrate have been a trade-off.

SUMMARY

An advantage of some aspects of the invention is that the size of a liquid ejecting head may be reduced while ensuring wiring width.

A liquid ejecting head according to an aspect of the invention includes a liquid ejection unit, a flexible substrate, and a case member. The liquid ejection unit includes a drive element, a pressure chamber, and a nozzle. A pressure of the pressure chamber is changed in accordance with drive of the drive element to eject a liquid from the nozzle. The flexible substrate is electrically connected to the drive element. The case member includes a flow channel configured to supply the liquid to the pressure chamber and an opening portion through which the flexible substrate is inserted. The flexible substrate has a straight portion and a wide portion having a width more than that of the straight portion. The case member has a side wall surrounding the opening portion, and a cutout portion formed in the side wall and configured to release the opening portion outward from the side wall. Portions of the side wall across the cutout portion are positioned outside the straight portion of the flexible substrate disposed in the opening portion. According to such a configuration, since the flexible substrate has the straight portion, and the wide portion having a width more than that of the straight portion, a wiring width can be sufficiently ensured to suppress heat generation. In addition, since the side wall surrounding the opening portion of the case member has a side wall formed with the cutout portion configured to release the opening portion outward from the side wall, and portions of the side wall across the cutout portion are positioned outside the straight portion of the flexible substrate disposed in the opening portion, the straight portion of the flexible substrate can be inserted into the opening portion from the cutout portion in the side wall to be stored in the opening portion. According to such a configuration, since the size of the opening portion does not need to be increased to insert the wide portion of the flexible substrate through the opening portion, the size of the opening portion can be reduced and thus the size of the liquid ejecting head can be reduced. Therefore, according to this aspect, the liquid ejecting head can be reduced in size while sufficiently ensuring a wiring width.

It is preferable that the portions of the side wall across the cutout portion form projecting portions projecting outside the straight portion of the flexible substrate disposed in the opening portion, and that a length from a bonding surface of the liquid ejection unit, on which the case member is bonded, to a boundary between the straight portion and the wide portion, be more than a height of the projecting portions from the bonding surface. According to such a configuration, since a length from the bonding surface of the liquid ejection unit, on which the case member is bonded, to the boundary between the straight portion and the wide portion, is more than a height of the projecting portions from the bonding surface, the flexible substrate can be inserted from the cutout portion into the opening portion such that the wide portion does not interfere with the projecting portions. Since the portions of the side wall across the cutout portion form projecting portions projecting outside the straight portion of the flexible substrate disposed in the opening portion, the projecting portions and the other parts of the side wall are readily held by hand, and even if the projecting portions and the side wall are held by hand, the flexible substrate is prevented from being touched by hand.

It is preferable that a length of the straight portion of the flexible substrate be less than a thickness of the case member. According to such a configuration, since the straight portion of the flexible substrate has a length less than a thickness of the case member, the length of the straight portion having a wiring width less than that of the wide portion can be reduced, compared with a case in which a length of the straight portion is more than the thickness of the case member. Therefore, heat generation can be effectively suppressed.

It is preferable that a width of the cutout portion be more than a width of the straight portion of the flexible substrate. According to such a configuration, since a width of the cutout portion for releasing the opening portion is more than a width of the straight portion of the flexible substrate, the straight portion can be inserted such that a substrate surface of the straight portion of the flexible substrate opposes the cutout portion. Accordingly, the flexible substrate can be readily inserted from the cutout portion, compared with a case in which the substrate surface of the straight portion is inserted to cross the cutout portion.

It is preferable that the case member be a rectangular substrate having long sides and short sides, and that the flexible substrate be disposed in the opening portion along the long sides of the case member. According to such a configuration, since the case member is a rectangular substrate having long sides and short sides and the flexible substrate is disposed in the opening portion along the long sides of the case member, the opening portion can be reduced in size in the direction of the long sides of the case member. Accordingly, the liquid ejecting head can be reduced in size in the direction of the long sides of the case member.

It is preferable that the opening portion of the case member overlap the center of the case member in plan view. According to such a configuration, since the opening portion of the case member overlaps the center of the case member in plan view, elements such as a liquid storage chamber can be disposed symmetrically about the axis (a center line passing through the center) of the case member, and the elements can be readily integrated.

It is preferable that the wide portion of the flexible substrate have a width increasing from the straight portion toward one end portion in a width direction. According to such a configuration, since the wide portion of the flexible substrate has a width increasing from the straight portion toward one end portion in the width direction, the flexible substrate can be disposed such that the one end portion protrudes from the case member. Therefore a wiring width can be increased while the case member is reduced in size.

It is preferable that the case member be a rectangular substrate having long sides and short sides, and that the flexible substrate be disposed in the opening portion along the short sides of the case member. According to such a configuration, since the case member is a rectangular substrate having long sides and short sides and the flexible substrate is disposed in the opening portion along the short sides of the case member, the case member can be reduced in size in the direction of long sides. Accordingly, the liquid ejecting head can be reduced in size in the direction of the long sides of the case member.

It is preferable that the opening portion of the case member do not overlap a center of the case member in plan view. According to such a configuration, since the opening portion of the case member does not overlap the center of the case member in plan view, a liquid storage chamber or the like can be expanded to a position near the center of the case member.

It is preferable that the opening portion have a width more than a width of the straight portion of the flexible substrate, and that a gap from an end portion of the straight portion disposed in the opening portion to an end portion of the opening portion have a length less than a distance from the end portion of the straight portion to an end portion of the wide portion. According to such a configuration, since the gap from the end portion of the straight portion disposed in the opening portion to the end portion of the opening portion has a length less than the distance from the end portion of the straight portion to the end portion of the wide portion, the end portion of the wide portion can be disposed protruding from the case member. Therefore a wiring width can be increased while the case member is reduced in size. Accordingly, the liquid ejecting head can be reduced in size while sufficiently ensuring a wiring width.

It is preferable that the case member have a liquid storage chamber along the long sides of the case member, the flexible substrate be disposed in the case member along the short sides of the case member, and an area of the case member in which the flexible substrate is disposed be positioned outside an area of the case member in which the liquid storage chamber is formed. According to such a configuration, the liquid storage chamber is formed in the case member along the long sides of the case member, the flexible substrate is disposed in the case member along the short sides of the case member, and the area of the case member in which the flexible substrate is disposed is positioned outside an area of the case member in which the liquid storage chamber is formed. Therefore, the liquid storage chamber can be increased in size or the number of the liquid storage chambers can be increased without expanding the liquid ejecting head, compared with a case in which a flexible substrate is disposed in the area in which the liquid storage chamber is formed.

It is preferable that the cutout portion be formed in a portion of the side wall of one of the short sides of the case member, the opening portion be formed along the short sides of the case member, and the cutout portion have a width more than the width of the straight portion of the flexible substrate. According to such a configuration, since the cutout portion is formed in a portion of the side wall of one of the short sides of the case member, the opening portion is formed along the short sides of the case member, and the cutout portion has a width more than the width of the straight portion of the flexible substrate, the straight portion of the flexible substrate can be inserted from the portion of the side wall of one of the short sides of the case member to dispose the flexible substrate at an end portion of the case member. Therefore, the number of areas of the case member in which the liquid storage chambers are disposed can be increased.

It is preferable that a height of the projecting portions from a bonding surface, on which the case member is bonded, of the liquid ejection unit be less than a thickness of the case member. According to such a configuration, since a height of the projecting portions from a bonding surface, on which the case member is bonded, of the liquid ejection unit is less than the thickness of the case member, a gap is readily formed between the wide portion of the flexible substrate and the projecting portions of the case member and the straight portion can be reduced in length, compared with a case in which the height of the projecting portions from the bonding surface is the same as the thickness of the case member.

It is preferable that the wide portion of the flexible substrate have an inclined portion inclined to have a width gradually increasing from the straight portion, and that a surface of the projecting portions opposing the wide portion have an inclined surface inclined in accordance with the inclination of the inclined portion of the wide portion. According to such a configuration, since the wide portion of the flexible substrate has the inclined portion inclined to have a width gradually increasing from the straight portion, and a surface of the projecting portions opposing the wide portion has the inclined surface inclined in accordance with the inclination of the inclined portion of the wide portion, the wide portion of the flexible substrate can be put closer to the projecting portions, compared with a case in which the projecting portions have no inclined surface. Therefore, the straight portion can be reduced in length, and heat generation can be effectively suppressed.

A liquid ejecting apparatus according to an aspect of the invention includes the liquid ejecting head according to any of the above configurations. According to such a configuration, a liquid ejecting apparatus can be provided which has a liquid ejecting head reduced in size while sufficiently ensuring a wiring width.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
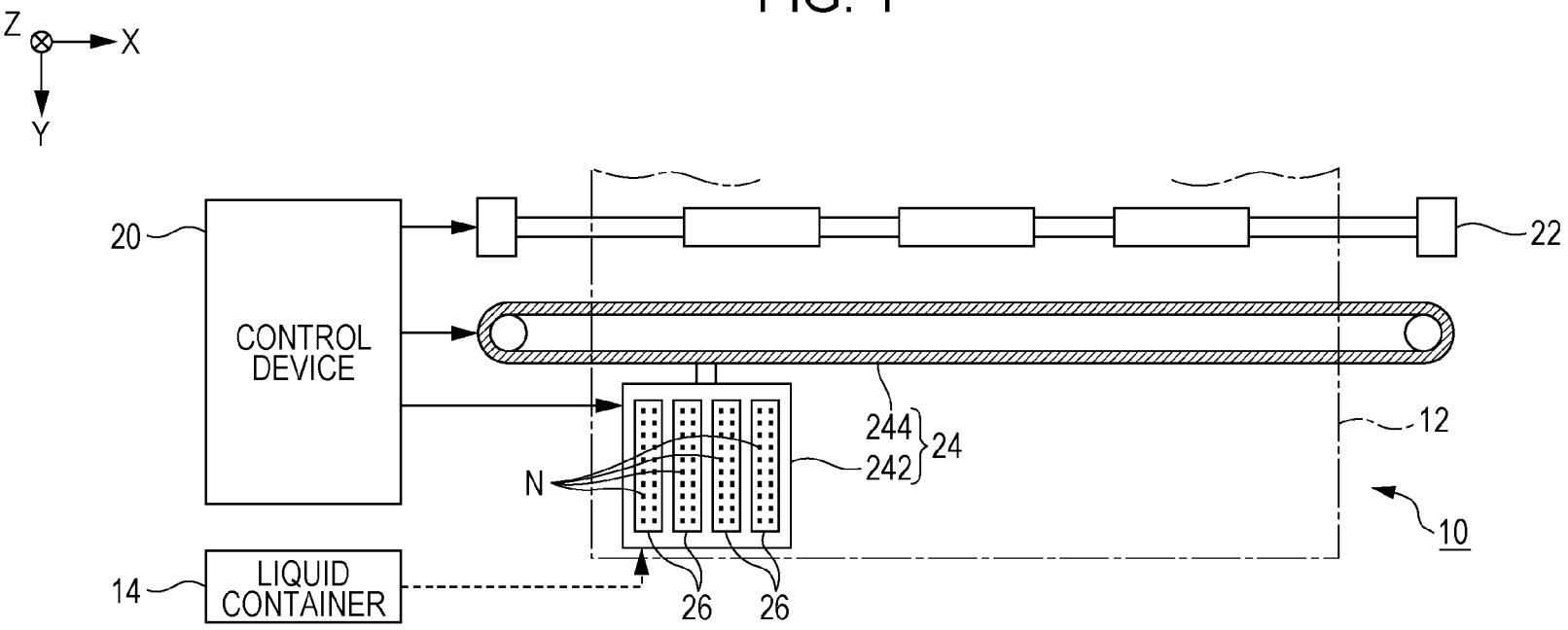
FIG. 1 is a schematic diagram of a liquid ejecting apparatus according to a first embodiment.

FIG. 1 is a schematic diagram illustrating an example of a liquid ejecting apparatus 10 according to a first embodiment of the invention. The liquid ejecting apparatus 10 according to the first embodiment is an ink jet printer that ejects a liquid, such as ink, onto a medium 12. The medium 12 is typically printing paper, but any object, such as a resin film or a fabric, may be used as the medium 12 for printing. As illustrated in FIG. 1, a liquid container 14 configured to store ink is fixed to the liquid ejecting apparatus 10. For example, a cartridge detachable from the liquid ejecting apparatus 10, an ink pack made of a flexible film in a bag shape, or an ink tank configured to be replenished with ink may be used as the liquid container 14. Different colors of ink may be stored in the liquid container 14.

As illustrated in FIG. 1, the liquid ejecting apparatus 10 includes a control device 20, a transport mechanism 22, a movement mechanism 24, and a plurality of liquid ejecting heads 26. The control device 20 includes a processing circuit, such as a central processing unit (CPU) or a field programmable gate array (FPGA), and a memory circuit, such as a semiconductor memory, and integrally controls elements of the liquid ejecting apparatus 10. The transport mechanism 22 transports the medium 12 in a Y direction (first direction) under the control of the control device 20.

The movement mechanism 24 reciprocates the plurality of liquid ejecting heads 26 in an X direction under the control of the control device 20. The X direction (second direction) is a direction crossing (typically, orthogonal to) the Y direction in which the medium 12 is transported. The movement mechanism 24 according to the first embodiment includes a carriage 242 onto which the plurality of liquid ejecting heads 26 is mounted, and an endless belt 244 to which the carriage 242 is fixed. Note that the liquid container 14 can be mounted on the carriage 242 together with the liquid ejecting heads 26.

Each of the plurality of liquid ejecting heads 26 ejects ink supplied from the liquid container 14 from a plurality of nozzles (ejection holes) onto the medium 12, under the control of the control device 20. Each of the liquid ejecting heads 26 includes a plurality of nozzles N arranged in the Y direction. The plurality of nozzles N according to the first embodiment are separated into two nozzle rows. The nozzles N can be positioned by shifting the position of each of the two nozzle rows in the Y direction (i.e., staggered arrangement), but FIG. 1 illustrates an example of a configuration in which the nozzles N are positioned by the two nozzle rows the positions of which coincide with each other in the Y direction.

In tandem with the transport of the medium 12 by the transport mechanism 22 and reciprocation of the carriage 242, each of the liquid ejecting heads 26 ejects ink onto the medium 12, and a desired image is formed on a surface of the medium 12. Note that a Z direction (third direction) is a direction perpendicular to an X-Y plane (e.g., a plane parallel to the surface of the medium 12). The direction of the ink ejected by each liquid ejecting head 26 (typically, vertical direction) corresponds to the Z direction.

Figure 2:
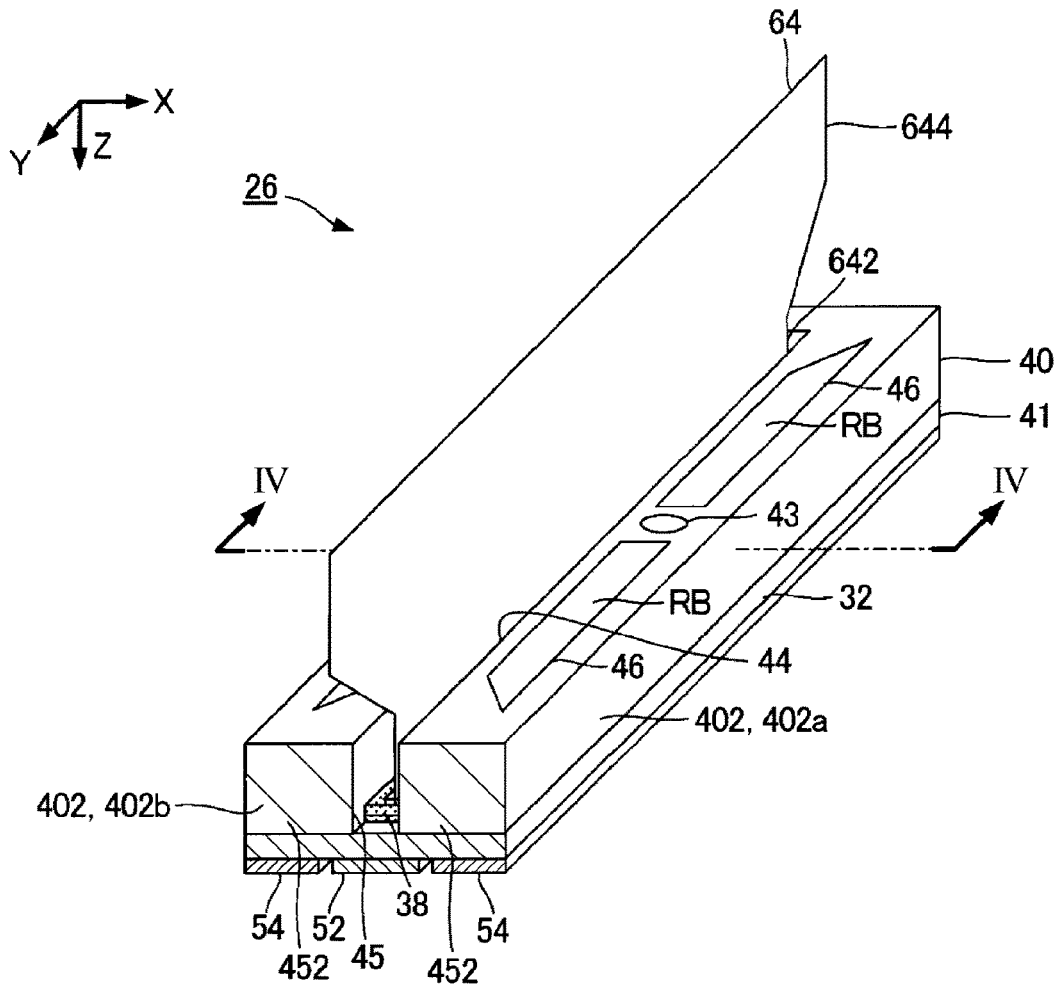
FIG. 2 is an external perspective view of a liquid ejecting head according to the first embodiment.
Figure 3:
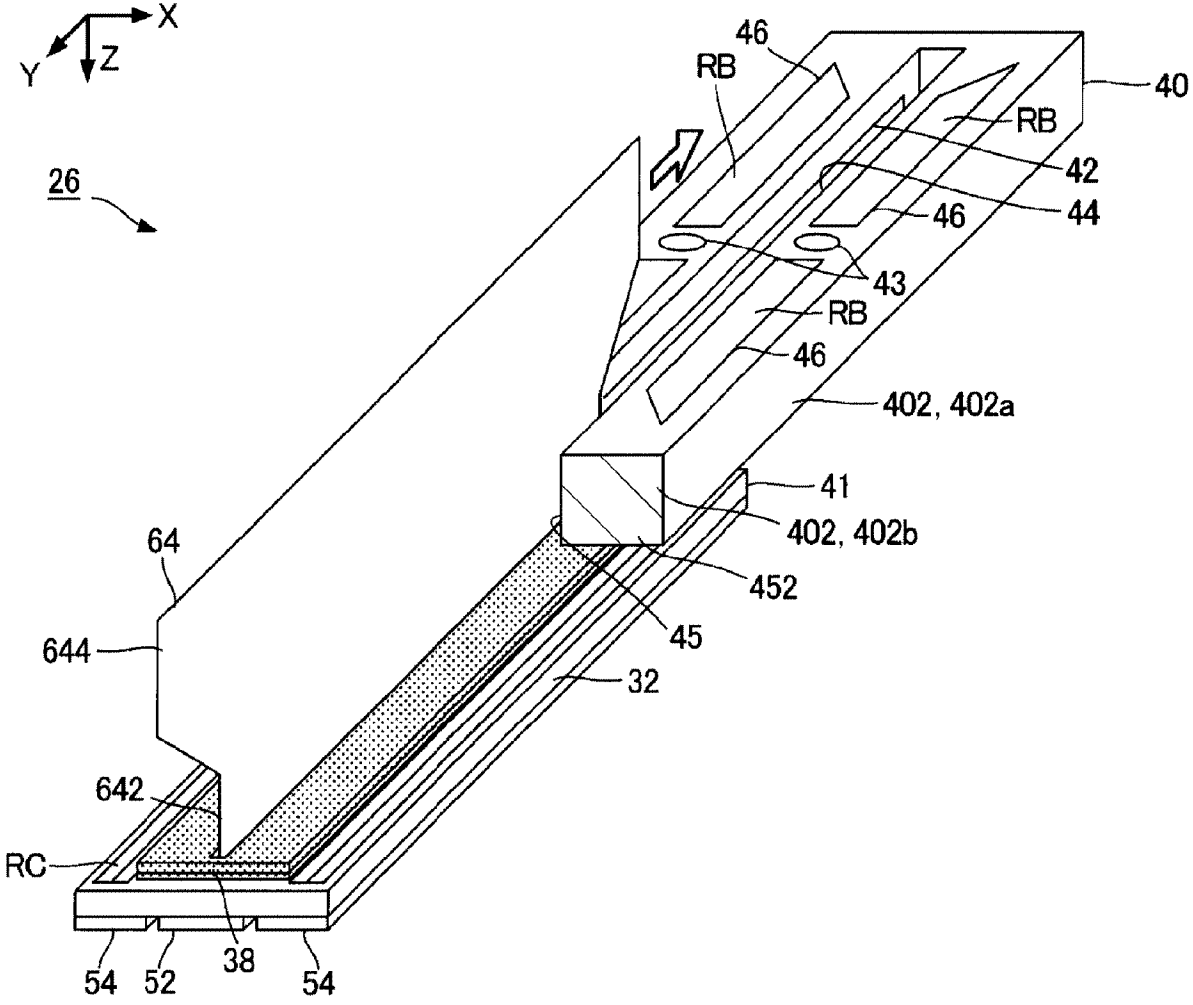
FIG. 3 is an exploded perspective view of the liquid ejecting head according to the first embodiment.
Figure 4:
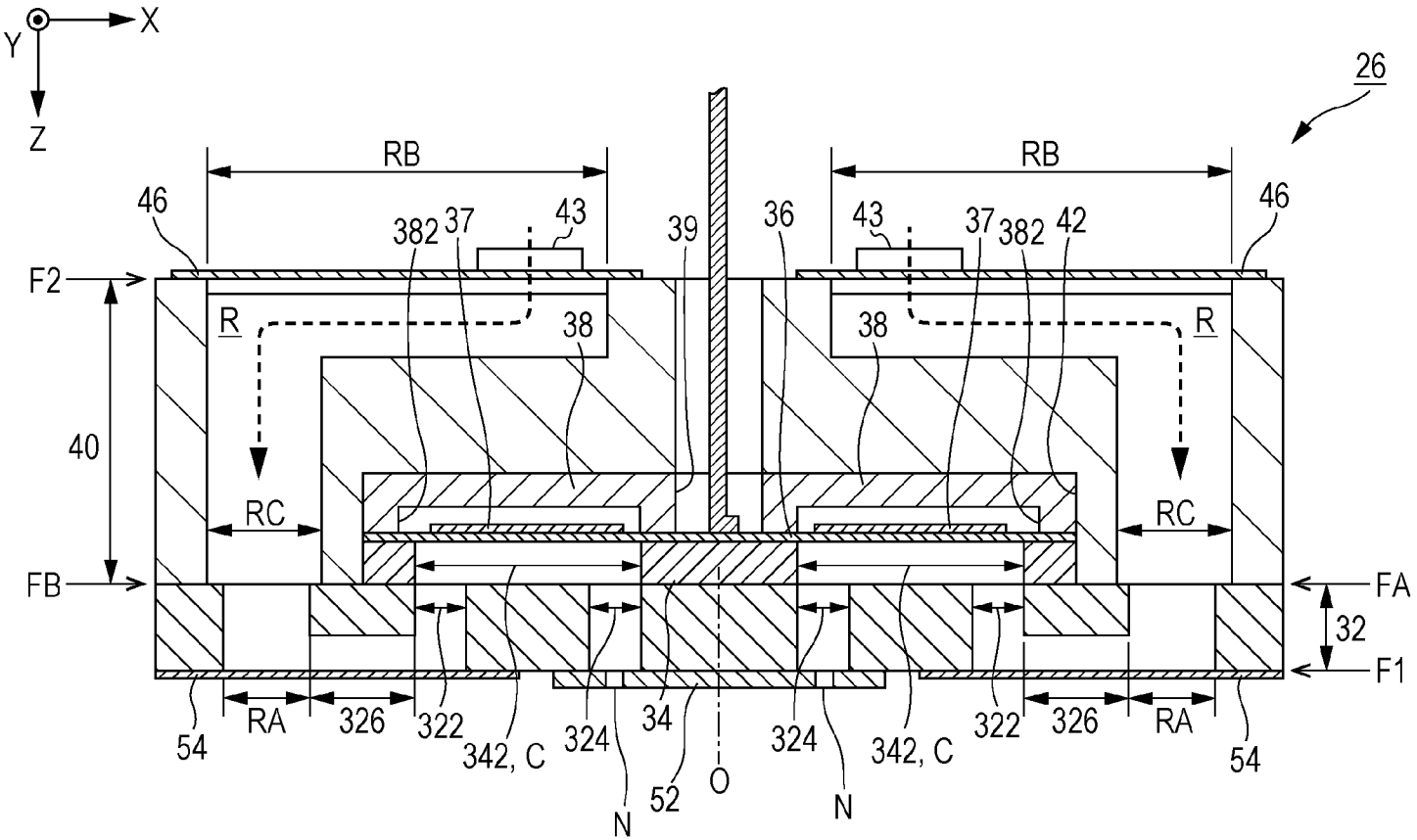
FIG. 4 is a cross-sectional view of the liquid ejecting head taken along line IV-IV of FIG. 2.

FIG. 2 is an external perspective view of a liquid ejecting head 26, and FIG. 3 is an exploded perspective view of the liquid ejecting head. FIG. 4 is a cross-sectional view taken along line IV-IV of FIG. 2. The liquid ejecting head 26 illustrated in FIG. 4 has a structure in which elements relating to two nozzles N are disposed substantially symmetrically about a line.

As illustrated in FIG. 2, the liquid ejecting head 26 according to the first embodiment includes a case member 40, a liquid ejection unit 41, and a flexible substrate 64. The liquid ejection unit 41 is obtained by stacking a plurality of substrates and includes a piezoelectric element (an example of drive element) 37, a pressure chamber C, and a nozzle N, which are illustrated in FIG. 4. The flexible substrate 64 is bonded to the liquid ejection unit 41 to be electrically connected to the piezoelectric element 37. The flexible substrate 64 is a flexible wiring board in which a plurality of wires (not illustrated) for electrically connecting the control device 20 to a drive circuit of the piezoelectric element 37 is formed. For example, a wiring board, such as a flexible printed circuit (FPC) or a flexible flat cable (FFC), is preferably adopted as the flexible substrate 64. The flexible substrate 64 according to the present embodiment includes a straight portion 642 standing on and bonded to the liquid ejection unit 41, and a wide portion 644 having a width larger than that of the straight portion 642. In the first embodiment, an example of the flexible substrate 64 having a width direction extending in the Y direction will be described. Accordingly, in the first embodiment, the flexible substrate 64 has a width extending in the Y direction.

The case member 40 includes a flow channel configured to supply ink to the pressure chamber C and an opening portion 44 through which the straight portion 642 of the flexible substrate 64 is inserted, and the case member 40 is bonded to the liquid ejection unit 41. A side wall 402 surrounding the opening portion 44 has a cutout portion 45 formed to release the opening portion 44 outward from the side wall 402 (positive Y direction in FIG. 2). According to the liquid ejecting head 26 having such a configuration, as illustrated in FIG. 3, while the flexible substrate 64 is bonded to the liquid ejection unit 41 such that the width direction of the flexible substrate 64 extends in the Y direction, the straight portion 642 of the flexible substrate 64 can be inserted into the cutout portion 45 in the Y direction to be disposed in the opening portion 44.

Hereinafter, elements of such a liquid ejecting head 26 according to the embodiment will be described in detail. As illustrated in FIGS. 2 to 4, the liquid ejection unit 41 includes a flow channel substrate 32. The flow channel substrate 32 is a plate-shaped member including a first surface F1 and a bonding surface FA. The first surface F1 is a surface in the positive Z direction (a surface near the medium 12), and the bonding surface FA is the side (in the negative Z direction) opposite to the first surface F1. A pressure chamber substrate 34, a vibration unit 36, a plurality of the piezoelectric elements 37, a protective member 38, and the case member 40 are provided on the bonding surface FA of the flow channel substrate 32, and a nozzle plate 52 and a second compliance substrate 54 are provided on the first surface F1. Each of the elements of the liquid ejecting head 26 is substantially a plate-shaped member elongated in the Y direction similarly to the flow channel substrate 32 and is, for example, bonded to other elements of the liquid ejecting head 26 with an adhesive. The direction in which the flow channel substrate 32, the pressure chamber substrate 34, the protective member 38, and the nozzle plate 52 are stacked is indicative of the Z direction.

The nozzle plate 52 is a plate-shaped member in which a plurality of nozzles N is formed, and, for example, is bonded on the first surface F1 of the flow channel substrate 32 with an adhesive. Each of the nozzles N is a through-hole through which ink passes. The nozzle plate 52 according to the first embodiment is manufactured using a semiconductor manufacturing technique (e.g., etching) to process a silicon (Si) single crystal substrate. However, for manufacturing the nozzle plate 52, any known material or method may be adopted.

The flow channel substrate 32 is a plate-shaped member for forming an ink flow channel. As illustrated in FIG. 4, in the flow channel substrate 32 according to the first embodiment, as will be described later, for each of the two nozzle rows, a space for constituting a second storage chamber RA as part of a liquid storage chamber R, a plurality of supply flow channels 322, and a plurality of communication flow channels 324, are formed. The second storage chamber RA of the liquid storage chamber R is disposed near the supply flow channels 322 and is an opening elongated in the Y direction in plan view (i.e., viewed in the Z direction). The supply flow channels 322 and the communication flow channels 324 are through-holes formed for each of the nozzles N. The plurality of supply flow channels 322 is arranged in the Y direction, and the plurality of communication flow channels 324 is similarly arranged in the Y direction. Furthermore, as illustrated in FIG. 4, an intermediate flow channel 326 extending through the plurality of supply flow channels 322 is formed on the first surface F1 of the flow channel substrate 32. The intermediate flow channel 326 connects the second storage chamber RA and the plurality of supply flow channels 322. In contrast, the communication flow channels 324 communicate with the nozzles N.

As illustrated in FIG. 4, the pressure chamber substrate 34 is a plate-shaped member having a plurality of openings 342 arranged in the Y direction for each of the two nozzle rows, and is bonded on the bonding surface FA of the flow channel substrate 32, for example, with an adhesive. The opening 342 is an elongated through-hole formed for each of the nozzles N in the X direction in plan view. The flow channel substrate 32 and the pressure chamber substrate 34 are formed, similarly to the nozzle plate 52 described above, for example, using a semiconductor manufacturing technique to process a silicon (Si) single crystal substrate. However, for manufacturing the flow channel substrate 32 and the pressure chamber substrate 34, any known material or method may be adopted.

The vibration unit 36 is provided on a surface of the pressure chamber substrate 34 opposite to the flow channel substrate 32. The vibration unit 36 is a plate-shaped member (vibration plate) elastically vibrated. Note that the pressure chamber substrate 34 and the vibration unit 36 can also be integrally formed by selectively and partially removing an area corresponding to an opening 342 of a plate-shaped member having a predetermined thickness in a plate thickness direction.

The bonding surface FA of the flow channel substrate 32 and the vibration unit 36 are disposed to face each other across each opening 342. A space positioned between the bonding surface FA of the flow channel substrate 32 and the vibration unit 36 in the opening 342 functions as the pressure chamber C for applying a pressure to ink in the space. The pressure chamber C is a space in which, for example, the X direction is in a longitudinal direction and the Y direction is in a transverse direction. The pressure chamber C is formed for each of the nozzles N. In each nozzle row, a plurality of the pressure chambers C are arranged in the Y direction. A pressure chamber C communicates with a second storage chamber RA via a supply flow channel 322 and the intermediate flow channel 326, and communicates with a nozzle N via a communication flow channel 324. Note that a narrow flow channel having a suitably narrow width can be formed in the opening 342 to apply a predetermined flow resistance.

On a surface of the vibration unit 36 on the side opposite to a pressure chamber C, the plurality of the piezoelectric elements 37 corresponding to different nozzles N is provided for each of the two respective nozzle rows. Each of the piezoelectric elements 37 is a drive element that deforms in response to the supply of a drive signal. The piezoelectric elements 37 are arranged in the Y direction and correspond to respective pressure chambers C. Each piezoelectric element 37 is a layered member in which a piezoelectric body is interposed between opposing electrodes. When the vibration unit 36 is vibrated in accordance with the deformation of the piezoelectric element 37, the pressure in the pressure chamber C is changed, and ink in the pressure chamber C is ejected through the communication flow channel 324 and the nozzle N.

The protective member 38 is a plate-shaped member configured to protect the plurality of piezoelectric elements 37 and is provided on a surface of the vibration unit 36 (or a surface of the pressure chamber substrate 34). Although any material or manufacturing method can be employed for the protective member 38, for example, a silicon (Si) single crystal substrate may be processed using a semiconductor manufacturing technique to form the protective member 38, as in the case of the flow channel substrate 32 and the pressure chamber substrate 34.

In a surface (hereinafter, referred to as "bonding surface") of the protective member 38 on the vibration unit 36 side, a storage space 382 configured to store the plurality of piezoelectric elements 37 is formed for each of the nozzle rows. The storage space 382 is a space recessed relative to the bonding surface and is formed into an elongated shape extending in the Y direction in line with the arrangement of the plurality of piezoelectric elements 37. An opening portion 39 extending in the Y direction is formed in the protective member 38. The opening portion 39 of the protective member 38 communicates with the opening portion 44 of the case member 40. The opening portion 39 of the protective member 38 and the opening portion 44 of the case member 40 have substantially the same shape, and the straight portion 642 of the flexible substrate 64 is inserted through the opening portions 39 and 44.

A terminal portion 643 provided at the straight portion 642 of the flexible substrate 64 is bent and bonded to the vibration unit 36. The flexible substrate 64 stands in the Z direction and is disposed in the opening portions 39 and 44. Although not illustrated, the drive circuits of the piezoelectric elements 37 according to the embodiment are disposed outside the case member 40, and a terminal portion of the flexible substrate 64 on a side opposite to the terminal portion 643 is connected to the drive circuits of the piezoelectric elements 37. Each of the piezoelectric elements 37 is vibrated in response to the supply of a drive signal supplied from each of the drive circuits via the flexible substrate 64.

The case member 40 illustrated in FIGS. 2 to 4 is a rectangular substrate, and the side wall 402 of the case member 40 includes two long sides 402*a* opposing each other and extending in the Y direction, and two short sides 402*b* opposing each other and extending in the X direction. The two long sides 402*a* extend in one direction (Y direction), and the two short sides 402*b* extend in the X direction crossing (orthogonal to) the long sides 402*a*. The case member 40 functions as a casing configured to store ink supplied to the plurality of pressure chambers C (further, to the plurality of nozzles N). A surface (hereinafter, referred to as a "bonding surface") FB of the case member 40 in the positive Z direction is fixed to the bonding surface FA of the flow channel substrate 32, for example, with an adhesive. The bonding surface FB of the case member 40 is formed with a recessed portion 42 having a groove shape and extending in the Y direction. The protective member 38 is housed in a storage space in the recessed portion 42.

As illustrated in FIG. 4, in the case member 40 according to the embodiment, a space for constituting a first storage chamber RB and a space for constituting an intermediate storage chamber RC are formed for each of the nozzle rows. The first storage chamber RB and the second storage chamber RA of the flow channel substrate 32 communicate with each other through the intermediate storage chamber RC. A space constituted by the second storage chamber RA, the first storage chamber RB, and the intermediate storage chamber RC functions as the liquid storage chamber (reservoir) R configured to store ink supplied to the plurality of pressure chambers C. The liquid storage chamber R is a common liquid chamber extending through the plurality of nozzles N. In a second surface F2 of the case member 40 on a side opposite to the flow channel substrate 32, an inlet 43 configured to introduce ink supplied from the liquid container 14 to the liquid storage chamber R is formed for each nozzle row.

The first storage chamber RB is a space elongated in the Y direction. The first storage chamber RB communicates with the inlet 43. The intermediate storage chamber RC is a space extended in the Z direction. The intermediate storage chamber RC is positioned downstream from the first storage chamber RB and communicates with the second storage chamber RA of the flow channel substrate 32. When viewed in the positive Z direction, the recessed portion 42 configured to store the protective member 38 is positioned between the intermediate storage chambers RC corresponding to the nozzle rows. Accordingly, each intermediate storage chamber RC is positioned on a side (in the positive or negative X direction) of the piezoelectric element 37 and the protective member 38. As described above, in the first embodiment, since the liquid storage chamber R includes the first storage chamber RB and the intermediate storage chamber RC, the capacity of the liquid storage chamber R can be increased compared with a configuration without the first storage chamber RB or the intermediate storage chamber RC.

As indicated by dotted arrows in FIG. 4, ink supplied from the liquid container 14 to the inlet 43 in the positive Z direction flows in a direction substantially parallel to the X-Y plane (e.g., horizontal direction, X direction) in the first storage chamber RB of the liquid storage chamber R and then flows into the intermediate storage chamber RC. In the intermediate storage chamber RC, the ink flows in the positive Z direction (e.g., vertically downward) and reaches the second storage chamber RA of the flow channel substrate 32. The ink stored in the liquid storage chamber R flows in the X direction in the intermediate flow channel 326, and the flow of the ink from the intermediate flow channel 326 is divided to flow into the plurality of supply flow channels 322 in the negative Z direction such that the pressure chambers C are filled with ink in parallel. The ink in the pressure chamber C flows in the communication flow channel 324 in the Z direction and ejected through the nozzle N.

The second compliance substrate 54 is disposed on the first surface F1 of the flow channel substrate 32. The second compliance substrate 54 is a flexible film configured to accommodate a variation in the pressure of ink in the liquid storage chamber R. The second compliance substrate 54 is disposed on the first surface F1 of the flow channel substrate 32 via the second storage chamber RA, the intermediate flow channel 326, and the plurality of supply flow channels 322 of the flow channel substrate 32 and constitutes a wall surface of the liquid storage chamber R (specifically, a bottom surface of the second storage chamber RA). Since the second compliance substrate 54 having such a configuration is disposed at positions closer to the pressure chambers C, variations in the pressures of the pressure chambers C transmitted to the second storage chamber RA via the plurality of supply flow channels 322, which are individual flow channels, can be accommodated by the second compliance substrate 54.

On the second surface F2 of the case member 40, a first compliance substrate 46 is provided. The first compliance substrate 46 is a flexible film configured to accommodate a variation in the pressure of ink in the liquid storage chamber R, as in the second compliance substrate 54. The first compliance substrate 46 is provided on the second surface F2 and constitutes a wall surface of the liquid storage chamber R (specifically, a top surface of the first storage chamber RB). The first compliance substrate 46 having such a configuration can accommodate a variation in the pressure of ink flowing from the inlet 43 to the first storage chamber RB.

As illustrated in FIG. 4, at least part of the first storage chamber RB overlaps the second storage chamber RA in plan view (i.e., viewed in the Z direction). Furthermore, at least part of the first compliance substrate 46 overlaps the second compliance substrate 54 in plan view. Furthermore, the pressure chamber C overlaps both the first storage chamber RB and the first compliance substrate 46 in plan view. It can also be said that the first storage chamber RB protrudes from the intermediate storage chamber RC in the X direction to overlap the piezoelectric element 37, and the overlapping portion is provided with the first compliance substrate 46. As described above, the component elements of the liquid ejecting head 26 overlap each other in plan view as much as possible, and thereby the liquid ejecting head 26 can be reduced in size.

As illustrated in FIGS. 2 and 3, the opening portion 44 of the case member 40 according to the embodiment is an elongated through-hole corresponding to the direction in which a long side 402*a* of the case member 40 extends and disposed to overlap the center 0 of the case member 40 in plan view. The opening portion 44 of the case member 40 overlaps the center of the case member 40 in plan view, and thereby, according to this configuration, as illustrated in FIG. 4, the elements, such as the liquid storage chambers R, can be disposed to be symmetric about a center line passing through the center O of the case member 40, and the elements can be readily integrated. The opening portion 44 extends through the second surface F2 and the recessed portion 42 of the case member 40 and is in communication with the opening portion 39 of the protective member 38. The straight portion 642 of the flexible substrate 64 according to the embodiment is disposed in the opening portion 44 in a direction (Y direction) in which the long sides 402*a* of the case member 40 extend. That is, the width direction of the straight portion 642 of the flexible substrate 64 corresponds to the direction in which the long sides 402*a* of the case member 40 extend. According to this configuration, since the opening portion 44 can be reduced in size in a direction of the long sides 402*a* of the case member 40, the liquid ejecting head 26 can be reduced in size in a direction of the long side 402*a* of the case member 40.

As illustrated in FIGS. 2 and 3, the cutout portion 45 according to the embodiment for releasing the opening portion 44 outward from the side wall 402 (positive Y direction) is formed in one of the short sides 402*b* (positive Y direction) of the side wall 402 of the case member 40. The cutout portion 45 releases the opening portion 44 outward from the short side 402*b* of the case member 40. As illustrated in FIG. 2, portions of the side wall 402 across the cutout portion 45 are positioned outside the straight portion 642 of the flexible substrate 64 disposed in the opening portion 44. In a configuration of FIG. 1, the portions of the side wall 402 across the cutout portion 45 are formed as two projecting portions 452 projecting outside the straight portion 642 (in the positive Y direction) of the flexible substrate 64 disposed in the opening portion 44.

According to such a configuration, as illustrated in FIG. 3, the straight portion 642 of the flexible substrate 64 can be inserted into the cutout portion 45 from the cutout portion 45 between the projecting portions 452 and disposed in the opening portion 44. Accordingly, after the flexible substrate 64 is bonded to the liquid ejection unit 41, the liquid ejection unit 41 can be bonded to the case member 40. If the liquid ejection unit 41 is bonded to the case member 40 before the flexible substrate 64 is bonded to the liquid ejection unit 41, a temperature rise in a process of bonding the flexible substrate 64 tends to cause warpage due to a difference in the coefficient of thermal expansion between the liquid ejection unit 41 and the case member 40. In contrast, in this embodiment, the liquid ejection unit 41 can be bonded to the case member 40 after the flexible substrate 64 is bonded to the liquid ejection unit 41, and generation of the warpage due to heat can be suppressed.

Figure 5A:
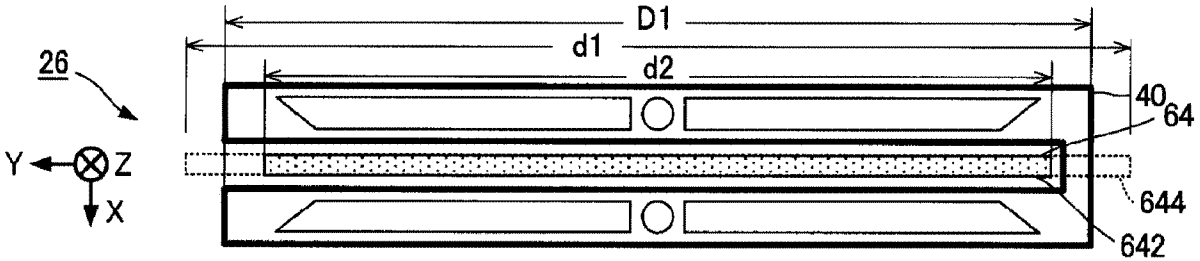
FIG. 5A is a top view of the liquid ejecting head according to the first embodiment.
Figure 5B:
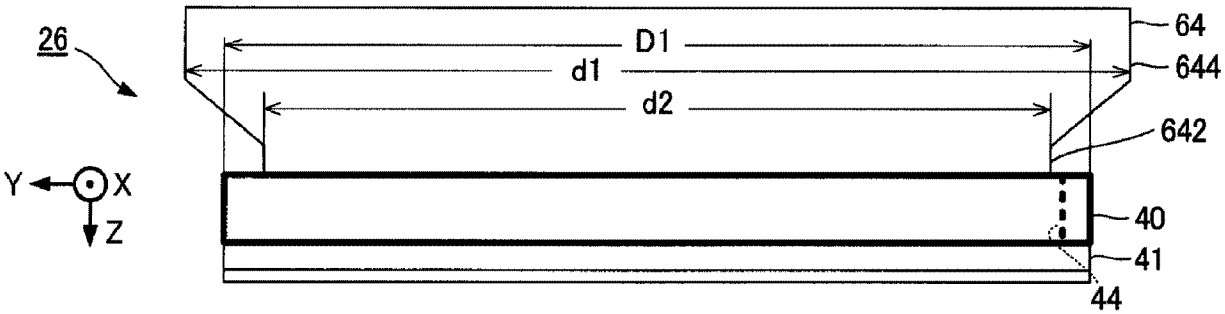
FIG. 5B is a side view of the liquid ejecting head according to the first embodiment.
Figure 5C:
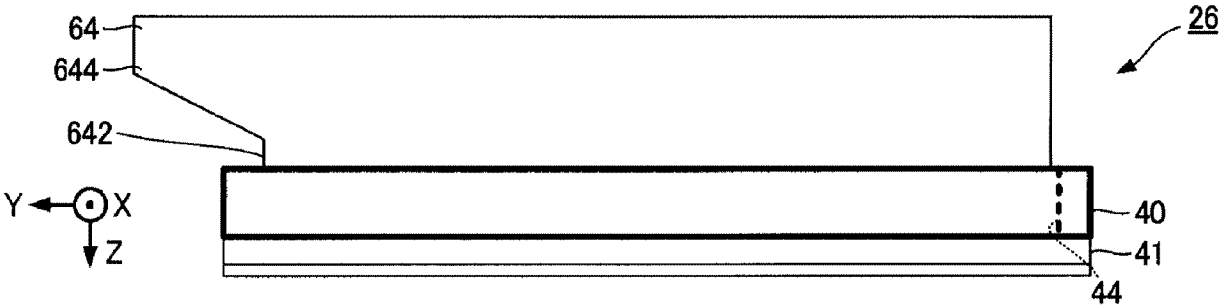
FIG. 5C is a side view of a liquid ejecting head according to a modification of the first embodiment.
Figure 6A:
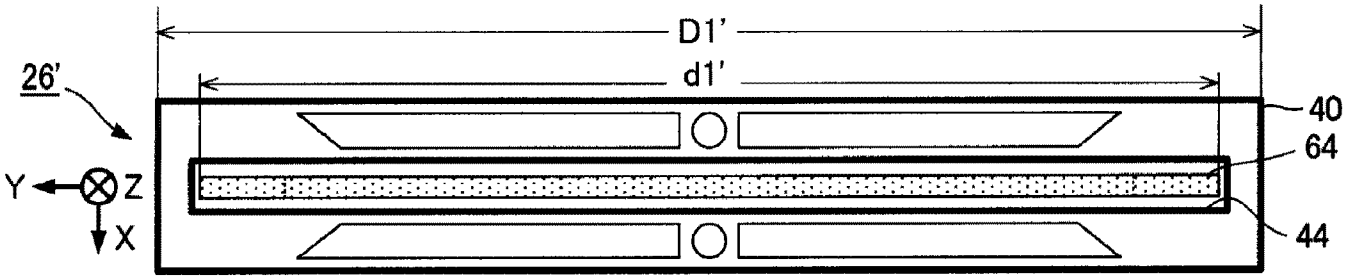
FIG. 6A is a top view of a liquid ejecting head according to a comparison example.
Figure 6B:
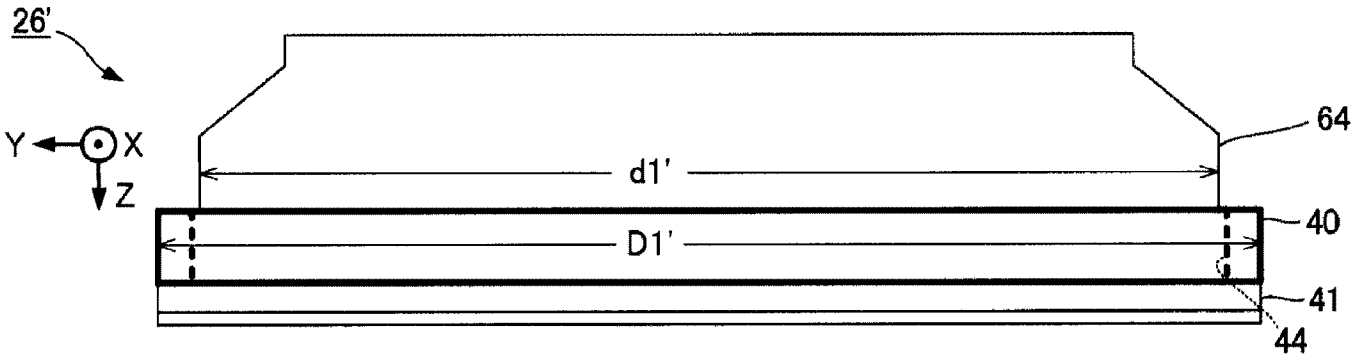
FIG. 6B is a side view of the liquid ejecting head according to the comparison example viewed from a long side.

Next, the opening portion 44 (cutout portion 45) of the case member 40 and the flexible substrate 64 according to the embodiment will be described compared with a comparison example. FIGS. 5A and 5B are views of a configuration according to the embodiment in which the cutout portion 45 is formed to release the opening portion 44, and FIGS. 6A and 6B are views of a configuration of a comparison example in which there is no cutout portion 45 configured to release the opening portion 44. FIG. 5A is a top view of the liquid ejecting head 26 according to the embodiment which is viewed in the negative Z direction, and FIG. 5B is a side view of the liquid ejecting head 26 which is viewed in the positive X direction. FIG. 6A is a top view of a liquid ejecting head 26' according to the comparison example of the embodiment which is viewed in the negative Z direction, and FIG. 6B is a side view of the liquid ejecting head 26' which is viewed in the positive X direction. FIG. 5C is a plan view of a modification of the flexible substrate 64 according to the embodiment.

As illustrated in FIGS. 6A and 6B, in the liquid ejecting head 26' according to the comparison example, the cutout portion 45 configured to release the opening portion 44 outward from a side wall 402 is not formed in the side wall 402 surrounding the opening portion 44 of the case member 40, the flexible substrate 64 cannot be inserted into the opening portion from a side, and the flexible substrate 64 needs to be inserted from below (in the positive Z direction). Therefore, the width of the opening portion 44 in the Y direction also needs to be increased to accommodate the maximum width d1' of the flexible substrate 64 when the flexible substrate 64 is inserted. Accordingly, in the comparison example, a width D1' of the case member 40 in the Y direction is more than the maximum width d1' as a mounting width of the flexible substrate 64, and there is the possibility of an increase in the size of the liquid ejecting head 26 in the Y direction (in a direction of the long side 402*a*).

In contrast, as illustrated in FIGS. 5A and 5B, in the liquid ejecting head 26 according to the embodiment, the cutout portion 45 configured to release the opening portion 44 outward from a side wall 402 is formed in the side wall 402 surrounding the opening portion 44 of the case member 40, and the projecting portions 452 as portions of the side wall 402 across the cutout portion 45 are positioned outside (in the positive Y direction) the straight portion 642 of the flexible substrate 64 disposed in the opening portion 44. Therefore, the straight portion 642 of the flexible substrate 64 can be inserted into the opening portion 44 from the cutout portion 45 in the side wall 402 so that the straight portion 642 is housed in the opening portion 44. According to this configuration, even if the width of the opening portion 44 in the Y direction is not increased to a size large enough to enable insertion of the wide portion 644, having the maximum width d1, of the flexible substrate 64, the width of the opening portion 44 may be large enough to enable insertion of the straight portion 642 as a mounting width d2.

Accordingly, the width of the opening portion 44 in the Y direction can be reduced compared with the comparison example, and the liquid ejecting head 26 can be reduced in size in the Y direction. Furthermore, according to the configuration of the embodiment, the wide portion 644 of the flexible substrate 64 can be increased in size relative to that of the opening portion 44 and can be increased in size relative to that of the width D1 of the case member 40 in the Y direction. Accordingly, since a wiring width can be further ensured compared with the comparison example, heat generation can be effectively suppressed. As described above, according to the embodiment, the liquid ejecting head 26 can be reduced in size while sufficiently ensuring a wiring width.

Note that the wide portion 644 of the flexible substrate 64 does not necessarily have a width increasing from the straight portion 642 to both sides in the Y direction. The wide portion 644 may have a width increasing from the straight portion 642 toward one end portion in the width direction. According to this configuration, as illustrated in the modification of FIG. 5C, the one end portion of the wide portion 644 may protrude from the case member 40, and the wiring width can be increased while the case member 40 is reduced in size. Furthermore, in the configuration according to the embodiment, since portions of the side wall 402 across the cutout portion 45 are formed as the projecting portions 452 projecting outside the straight portion 642 of the flexible substrate 64 disposed in the opening portion 44, the projecting portions 452 and the portion of the other side wall 402 (e.g., a short side 402*b* on a side opposite to the short side 402*b* having the projecting portions 452) may be readily held by hand, and even if the portion of the other side wall 402 and other portion of the side wall 402 are held by hand, the flexible substrate 64 is prevented from being touched by hand.

Second Embodiment

A second embodiment of the invention will be described. In the following examples, elements having similar effects or functions to those in the first embodiment are denoted by the same reference symbols used in the description of the first embodiment, and detailed description thereof will be omitted accordingly. In the first embodiment, the flexible substrate 64 disposed along the long sides 402*a* of the case member 40 extending in the Y direction has been exemplified, but in the second embodiment, the flexible substrate 64 disposed along the short sides 402*b* of the case member 40 extending in the X direction will be exemplified. That is, in the second embodiment, the flexible substrate 64 having a width direction extending in the X direction will be described. Accordingly, in the second embodiment, the width of the flexible substrate 64 extends in the X direction.

Figure 7:
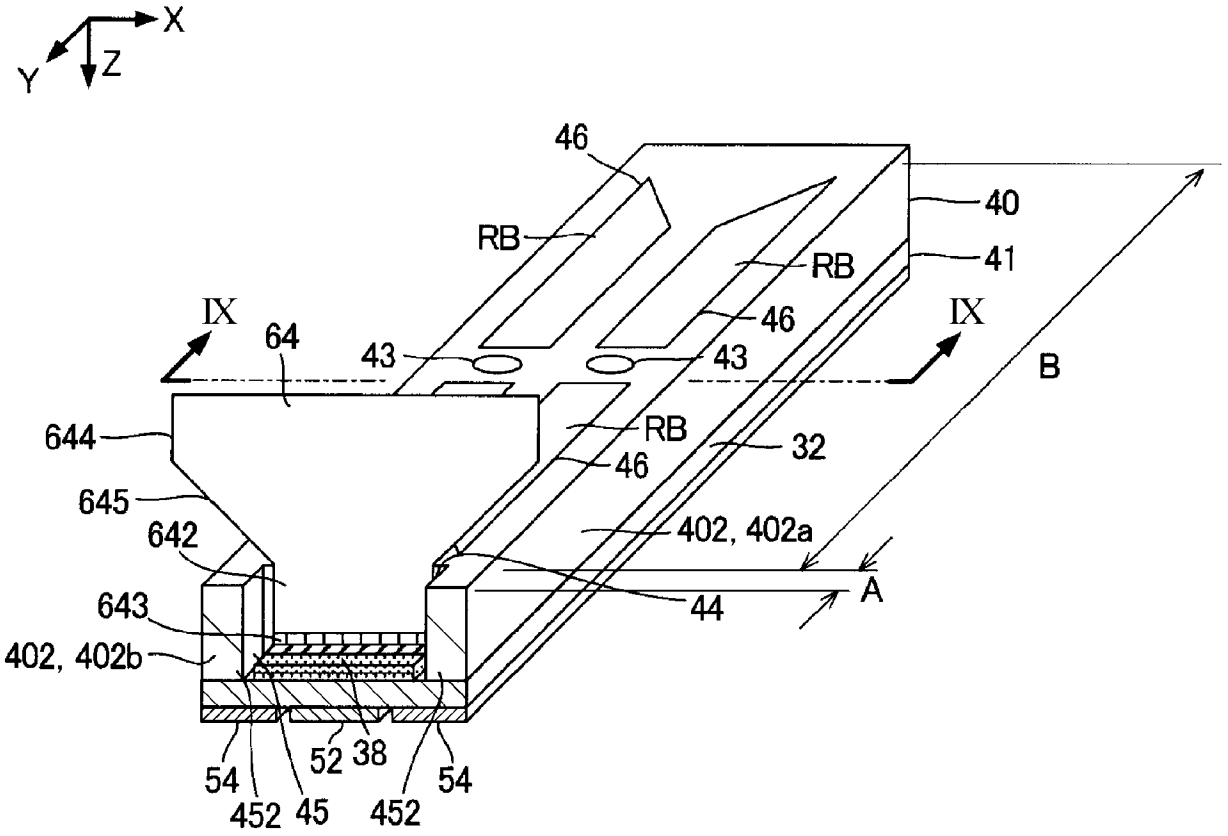
FIG. 7 is an external perspective view of a liquid ejecting head according to a second embodiment.
Figure 8:
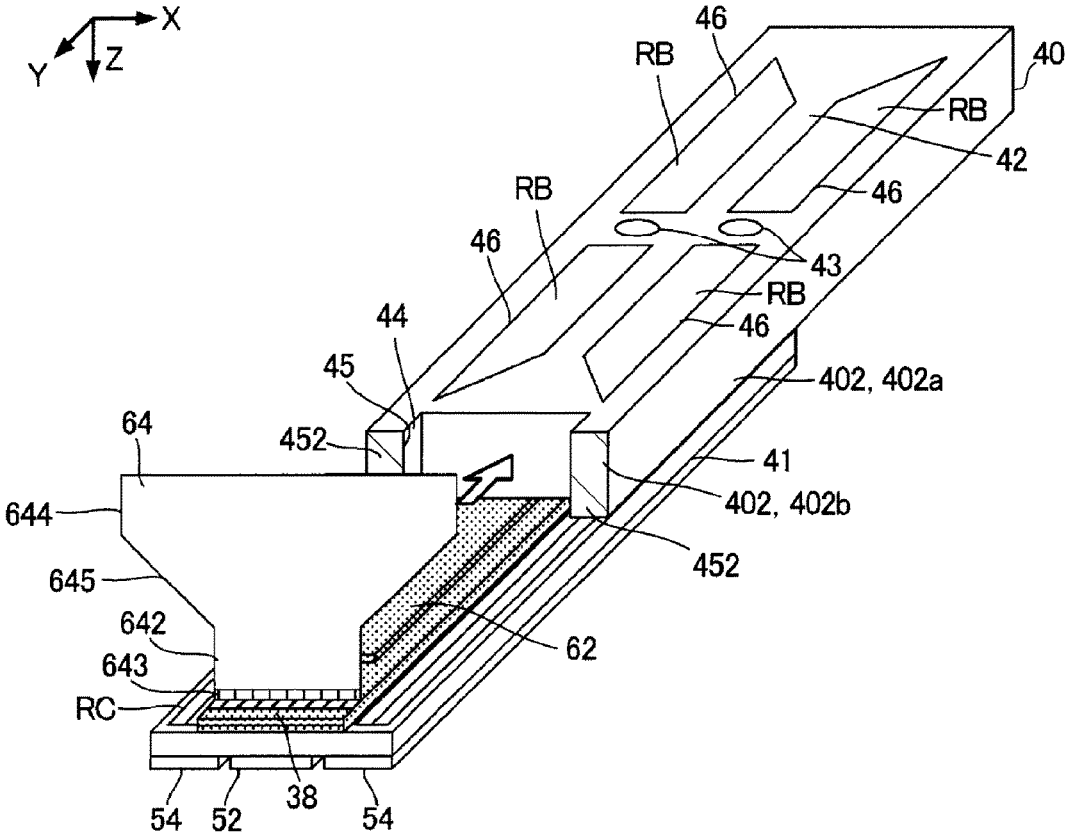
FIG. 8 is an exploded perspective view of the liquid ejecting head according to the second embodiment.
Figure 9:
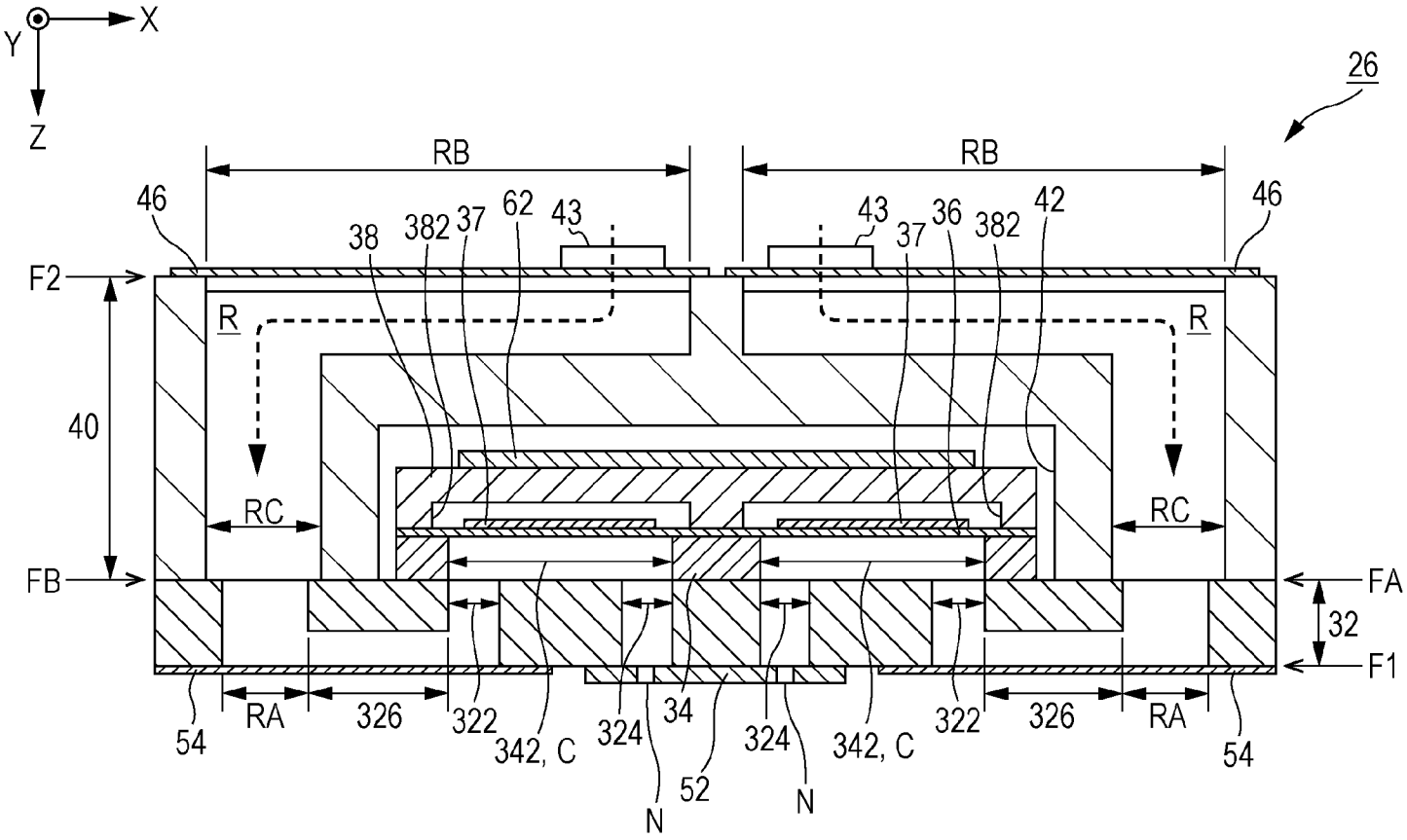
FIG. 9 is a cross-sectional view of the liquid ejecting head according to the second embodiment taken along line IX-IX.
Figure 10:
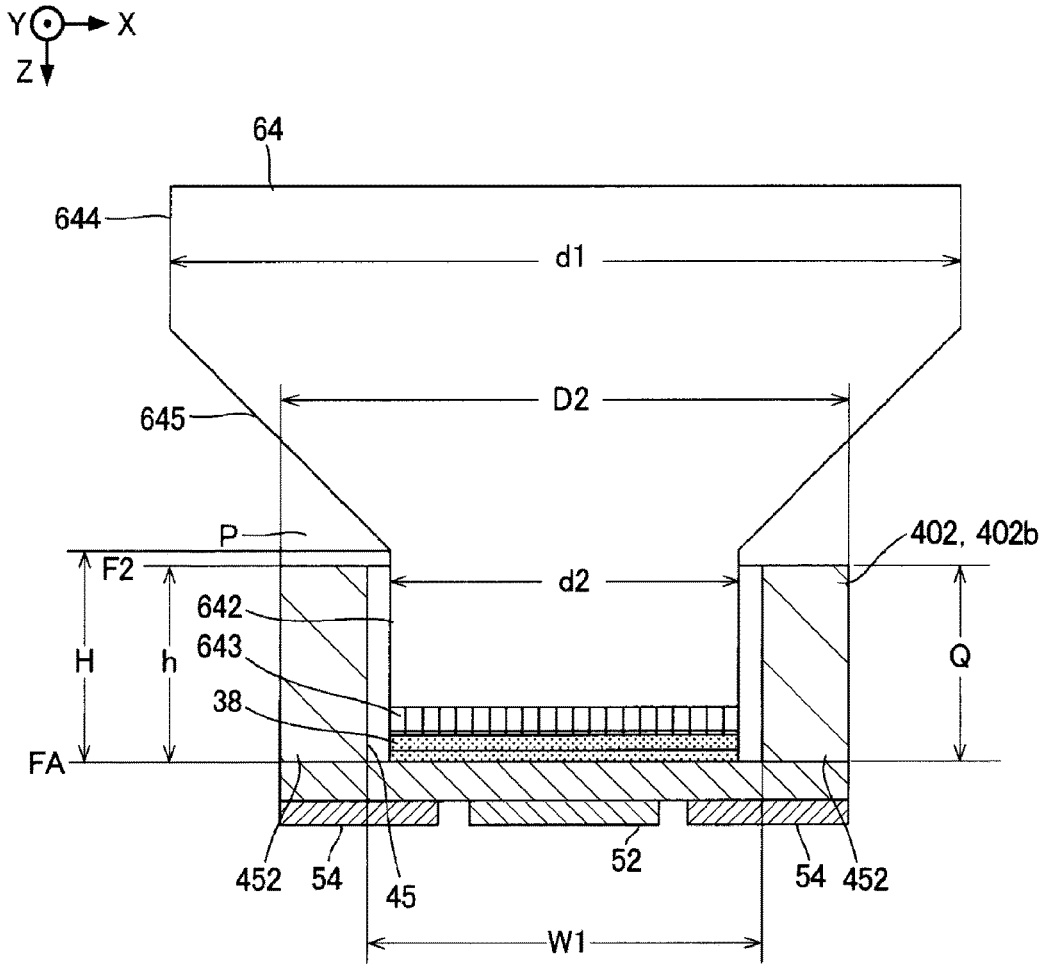
FIG. 10 is a side view of the liquid ejecting head according to the second embodiment viewed from a short side.

FIG. 7 is an external perspective view of the liquid ejecting head 26 according to the second embodiment, and FIG. 8 is an exploded perspective view of the liquid ejecting head 26. FIG. 9 is a cross-sectional view taken along line IX-IX of FIG. 7. FIG. 10 is a side view of the liquid ejecting head 26 according to the second embodiment which is viewed in the positive Y direction (from a short side). As illustrated in FIG. 7, in the liquid ejecting head 26 according to the second embodiment, the case member 40 has an opening portion 44 which is a through-hole formed along the short sides 402*b* of the case member 40 and does not overlap the center O of the case member 40 in plan view. The opening portion 44 according to the second embodiment is positioned near one of the short sides 402*b* of the case member 40 (in the positive Y direction), and the flexible substrate 64 inserted into the opening portion 44 is also provided near the short side 402*b* of the case member 40 (in the positive Y direction).

As illustrated in FIGS. 7 and 10, the cutout portion 45 configured to release the opening portion 44 according to the second embodiment outward from the side wall 402 (in the positive Y direction) is formed in one of the short sides 402*b* of the side wall 402 of the case member 40, the opening portion 44 is formed along the short side 402*b* of the case member 40, and the cutout portion 45 has a width W1 in the X direction more than the width d2 (the width extending in the X direction, in the second embodiment) of the straight portion 642 of the flexible substrate 64. Accordingly, in the second embodiment, as illustrated in FIG. 8, while the flexible substrate 64 is bonded to the liquid ejection unit 41 such that the width direction extends in the X direction, the straight portion 642 of the flexible substrate 64 can be inserted into the cutout portion 45 in the Y direction to be disposed in the opening portion 44. Accordingly, also in the second embodiment, the liquid ejection unit 41 can be bonded to the case member 40 after the flexible substrate 64 is bonded to the liquid ejection unit 41, and generation of the warpage due to heat can be suppressed.

Since the flexible substrate 64 according to the embodiment is disposed in the opening portion 44 along the short sides 402*b* of the case member 40, the case member 40 can be reduced in size in a direction of the long sides 402*a*. Accordingly, the liquid ejecting head 26 can be reduced in size in the direction of the long sides 402*a* of the case member 40. Furthermore, an area A of the case member 40 where the flexible substrate 64 is disposed in the opening portion 44 is positioned outside (in the positive Y direction) an area B of the case member 40 in which a liquid storage chamber R is formed. Accordingly, the liquid storage chamber R can be increased in size or the number of the liquid storage chambers can be increased without expanding the liquid ejecting head 26, compared with the flexible substrate 64 disposed in an area in which the liquid storage chamber R is formed as illustrated in FIG. 2.

For example, as illustrated in FIG. 9, in the second embodiment, since the opening portion 44 is not formed at a position passing through the center 0 of the case member 40, the first storage chamber RB can be expanded to a position near the center O. Furthermore, as illustrated in FIG. 9, a drive IC 62 including a drive circuit configured to drive the piezoelectric elements 37 may be provided in the protective member 38. The drive IC 62 is a substantially rectangular IC chip on which the drive circuit is mounted to drive the piezoelectric elements 37 in response to the generation and supply of a drive signal under the control of the control device 20. The protective member 38 according to the second embodiment also functions as a wiring board in which a plurality of wires is formed to be connected to input terminals of the drive IC 62. Accordingly, as illustrated in FIGS. 7 and 8, the flexible substrate 64 according to the second embodiment is bonded to the protective member 38 functioning as the wiring board.

As illustrated in FIG. 10, the terminal portion 643 of the flexible substrate 64 according to the second embodiment is bent and bonded to the protective member 38. FIG. 10 illustrates an example of the projecting portions 452 having a height h in the Z direction equal to a thickness Q of the case member 40 in the Z direction. The flexible substrate 64 stands and is disposed in the opening portion 44 in the Z direction. A length H is more than the height h of the projecting portions 452, where the length H extends in the Z direction from the bonding surface FA of the liquid ejection unit 41 on which the case member 40 is bonded to a boundary between the straight portion 642 and the wide portion 644 of the flexible substrate 64, and the height h extends in the Z direction from the bonding surface FA. Accordingly, the flexible substrate 64 can be inserted into the opening portion 44 from the cutout portion 45 so that the wide portion 644 does not interfere with the projecting portions 452.

The length of the straight portion 642 of the flexible substrate 64 illustrated in FIG. 10 is less than the thickness Q of the case member 40 in the Z direction. Accordingly, compared with a case in which the length of the straight portion 642 of the flexible substrate 64 is more than the thickness Q of the case member 40, the straight portion 642 having a wiring width (width in the X direction in FIG. 10) less than that of the wide portion 644 can be reduced in length, and heat generation can be effectively suppressed. The width W1 of the cutout portion 45 is more than the width d2 of the straight portion 642 of the flexible substrate 64. According to such a configuration, the straight portion 642 can be inserted such that a flat surface of the straight portion 642 of the flexible substrate 64 (substrate surface) opposes the cutout portion 45. Accordingly, the flexible substrate 64 can be readily inserted from the cutout portion 45, compared with a flat surface of the straight portion 642 inserted to cross the cutout portion 45. Since there is a gap P between the wide portion 644 of the flexible substrate 64 and the projecting portions 452 of the case member 40, the flexible substrate 64 can be disposed in the opening portion 44 so that the wide portion 644 does not interfere with the projecting portions 452.

Figure 11:
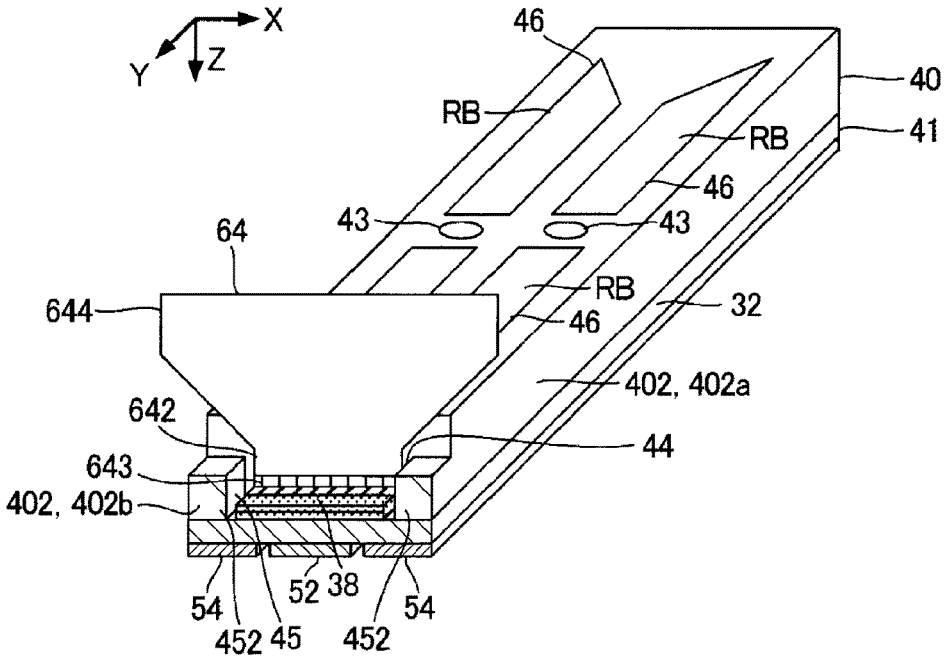
FIG. 11 is an external perspective view of a liquid ejecting head according to a first modification of the second embodiment.
Figure 12:
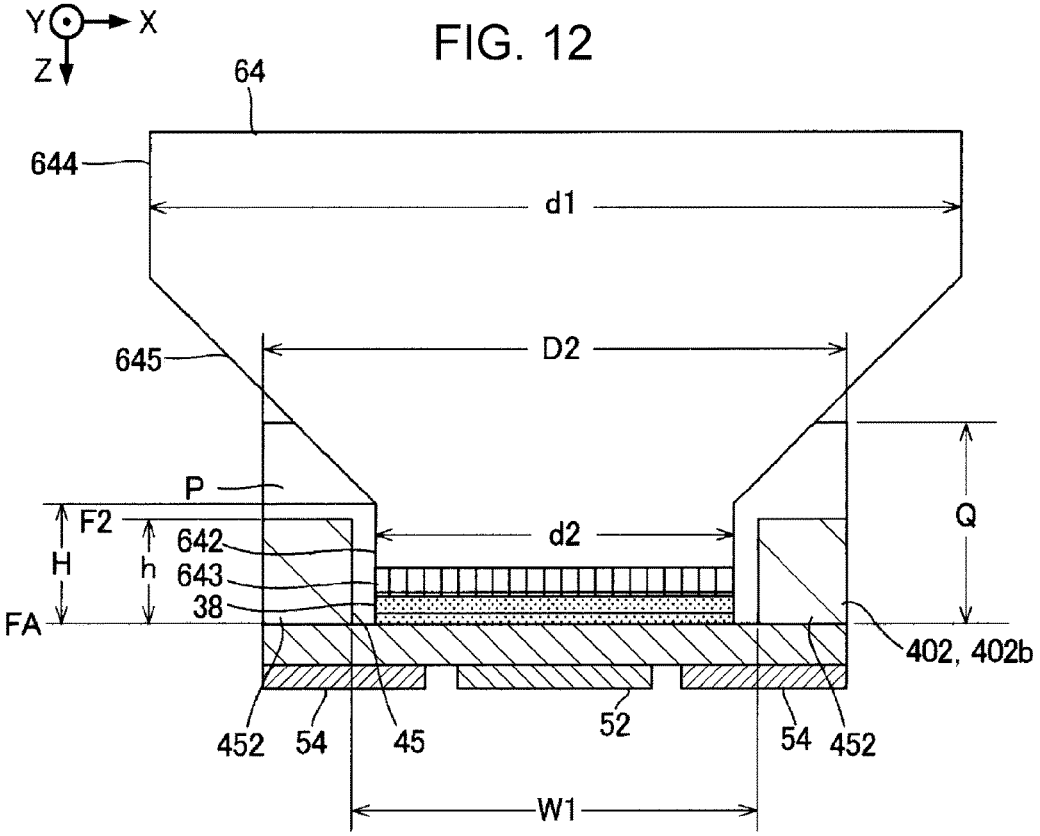
FIG. 12 is a side view of the liquid ejecting head according to the first modification of the second embodiment viewed from a short side.

Note that, in the configuration of FIGS. 7 and 10, the height h of the projecting portions 452 in the Z direction from the bonding surface FA, equal to the thickness Q of the case member 40, has been exemplified, but the height h is not limited to the above description. For example, as in the first modification illustrated in FIGS. 11 and 12, the height h of the projecting portions 452 in the Z direction from the bonding surface FA may be less than the thickness Q of the case member 40 in the Z direction. In FIG. 12, the height h of the projecting portions 452 from the bonding surface FA is less than the thickness Q of the case member 40. According to this configuration, compared with the example of FIG. 10 in which the height h of the projecting portions 452 from the bonding surface FA is equal to the thickness Q of the case member 40, a gap can be formed easily between the wide portion 644 of the flexible substrate 64 and the projecting portions 452 of the case member 40, and the straight portion 642 can be reduced in length.

Figure 13:
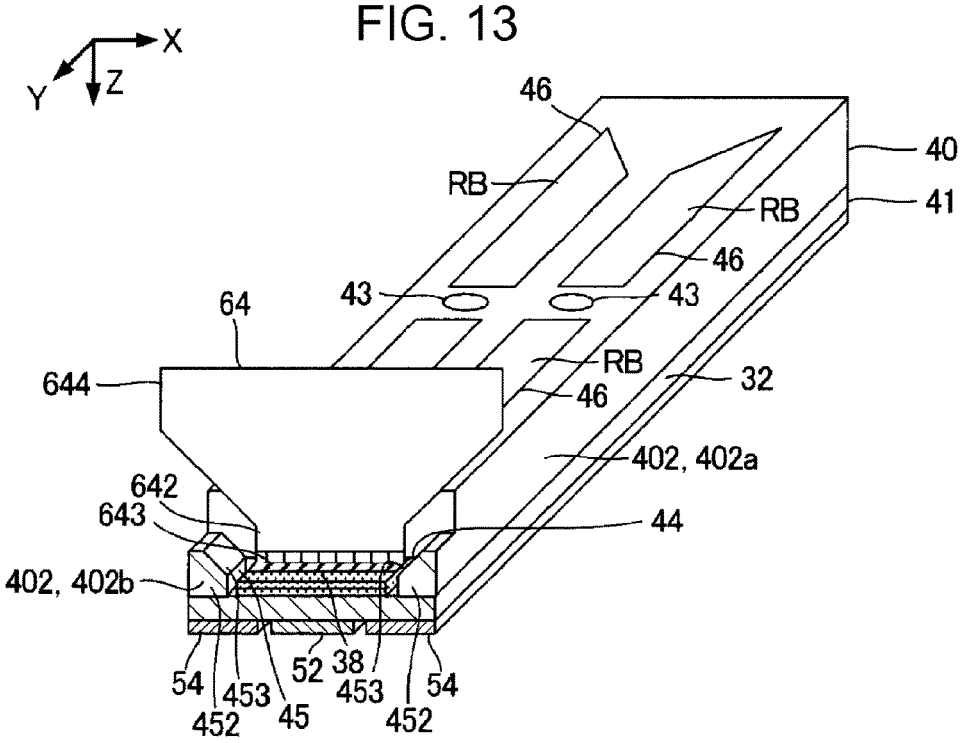
FIG. 13 is an external perspective view of a liquid ejecting head according to a second modification of the second embodiment.
Figure 14:
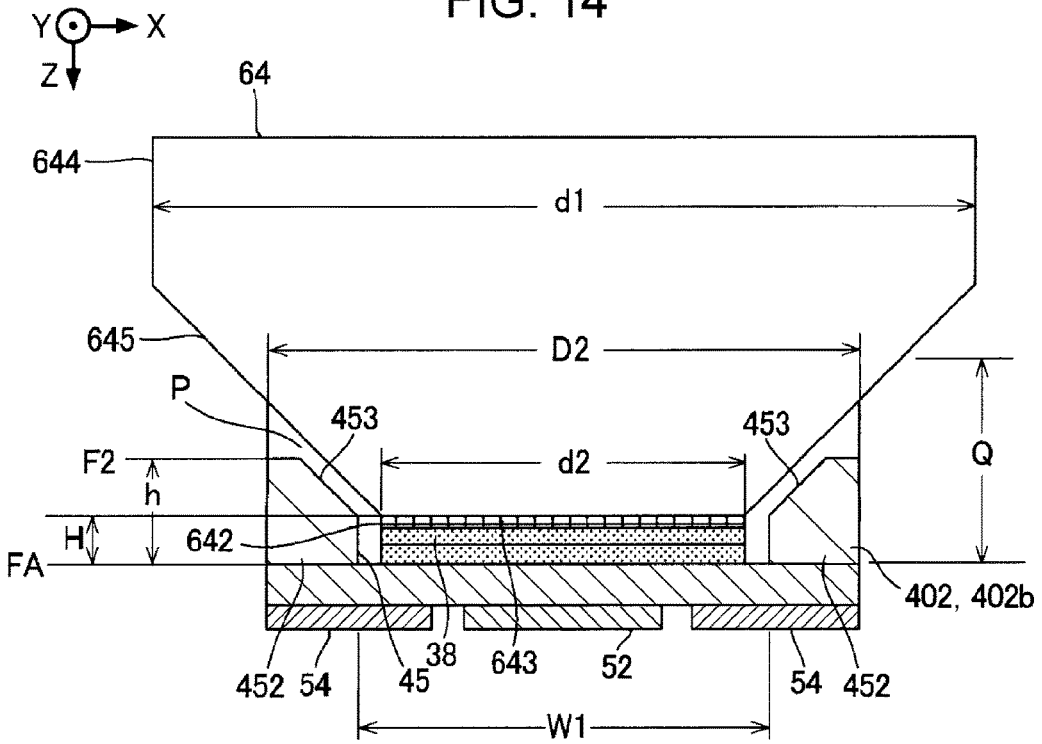
FIG. 14 is a side view of the liquid ejecting head according to the second modification of the second embodiment viewed from a short side.

Furthermore, when the wide portion 644 of the flexible substrate 64 has an inclined portion 645 inclined to have a width gradually increasing from the straight portion 642, as in a second modification of FIGS. 13 and 14, a surface of the projecting portions 452 opposing the wide portion 644 (a surface in the negative Z direction) may have an inclined surface 453 inclined in accordance with the inclination of the inclined portion 645 of the wide portion 644. According to this configuration, since the wide portion 644 of the flexible substrate 64 can be positioned closer to the projecting portions 452, compared with the projecting portions 452 without the inclined surface 453, the straight portion 642 can be reduced in length, and heat generation can be effectively suppressed.

Figure 15:
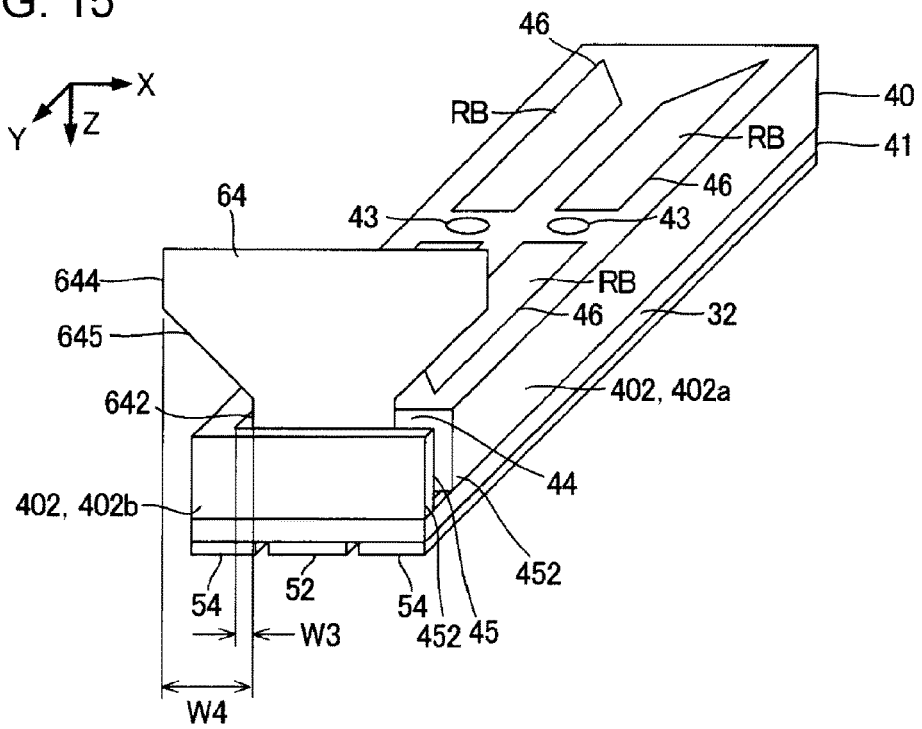
FIG. 15 is an external perspective view of a liquid ejecting head according to a third modification of the second embodiment.
Figure 16:
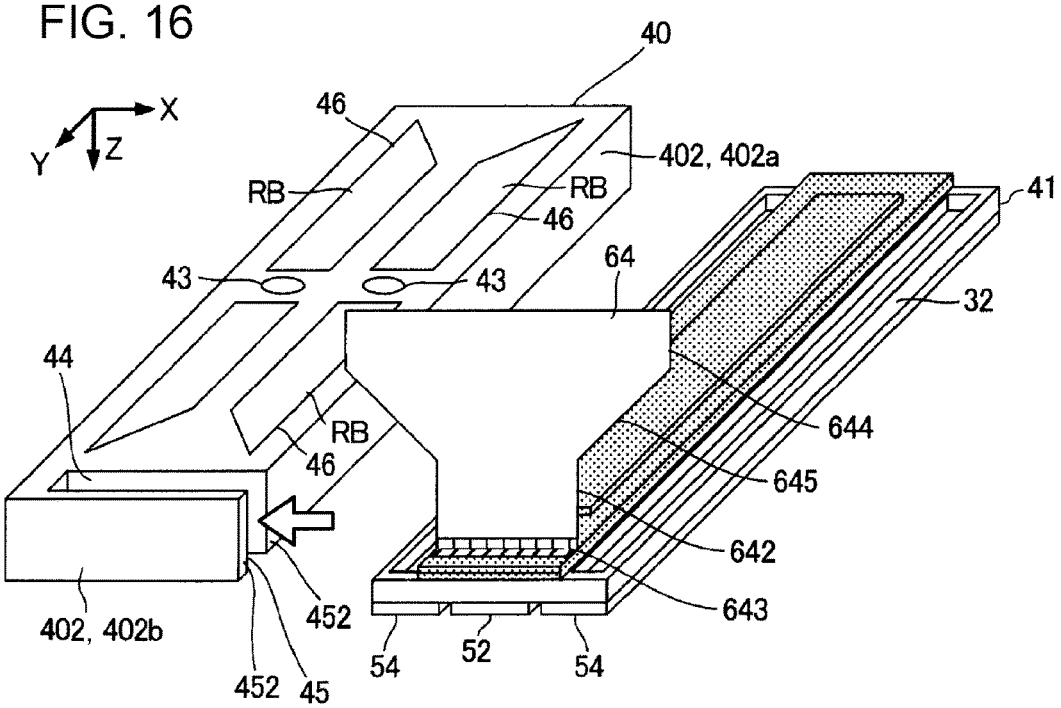
FIG. 16 is a side view of the liquid ejecting head according to the third modification of the second embodiment viewed from a short side.

Furthermore, in the second embodiment, the cutout portion 45 configured to release the opening portion 44, provided in one of the short sides 402*b* of the side wall 402 of the case member 40, has been exemplified, but the position of the cutout portion 45 is not limited to the above description, and in accordance with a third modification of FIGS. 15 and 16, the cutout portion 45 configured to release the opening portion 44 may be provided in one of the long sides 402*a* of the side wall 402 of the case member 40. In this configuration, portions of the side wall 402 across the cutout portion 45 are positioned outside the straight portion 642 of the flexible substrate 64 disposed in the opening portion 44, but, the outside indicates the positive X direction. According to this configuration, as illustrated in FIG. 16, while the flexible substrate 64 is bonded to the liquid ejection unit 41 such that the width direction extends in the X direction, the straight portion 642 of the flexible substrate 64 can be inserted into the cutout portion 45 in the X direction to be disposed in the opening portion 44. According to this configuration, since each of the short sides 402*b* does not have a cutout portion 45, the opposing short sides 402*b* of the case member 40 can be easily held by hand. Furthermore, as illustrated in FIG. 15, a length W3 of a gap from an end portion of the straight portion 642 disposed in the opening portion 44 to an end portion of the opening portion is less than a distance W4 from an end portion of the straight portion 642 to an end portion of the wide portion 644. According to this configuration, since the flexible substrate 64 can be disposed such that the end portion of the wide portion 644 protrudes from case member 40, the wiring width can be increased while the case member 40 is reduced in size. Accordingly, the liquid ejecting head 26 can be reduced in size while sufficiently ensuring a wiring width.

Modifications

The above examples and embodiments can be variously modified. Specific examples of modification will be exemplified below. Two or more of examples desirably selected from the following examples or the above-described examples may be appropriately combined with each other without any contradictions.

(1) In the above embodiments, there has been exemplified a serial head printer in which the carriage 242 onto which the liquid ejecting heads 26 are mounted is reciprocated in the X direction, but the invention can also be applied to a line head printer in which the liquid ejecting heads 26 are arranged over the whole width of the medium 12.

(2) In the above embodiments, the liquid ejecting head 26 of a piezoelectric type which uses the piezoelectric element for mechanically vibrating the pressure chamber has been exemplified, but a thermal liquid ejecting head which uses a heating element for thermally generating bubbles in the pressure chamber may be adopted.

(3) The liquid ejecting apparatus 10 exemplified in the above embodiments may be adopted for various apparatuses, such as a facsimile machine or a copying machine, in addition to an apparatus dedicated to printing. Moreover, the use of the liquid ejecting apparatus 10 according to the invention is not limited to printing. For example, a liquid ejecting apparatus for ejecting a colorant solution may be used for a manufacturing apparatus for forming a color filter of a liquid crystal display, an organic electroluminescence (EL) display, a field emission display (FED), or the like. Furthermore, a liquid ejecting apparatus for ejecting an electroconductive solution is used for a manufacturing apparatus for forming a wire or an electrode for a wiring board. Furthermore, the invention can also be used for a chip manufacturing apparatus for ejecting a bioorganic solution as a kind of liquid.

What is claimed is:

1. A liquid ejecting head comprising:

a liquid ejection unit including a drive element, a pressure chamber, and a nozzle, a pressure of the pressure chamber being changed in accordance with drive of the drive element to eject a liquid from the nozzle, a flexible substrate electrically connected to the drive element; and a case member including a flow channel configured to supply the liquid to the pressure chamber, and an opening portion through which the flexible substrate is inserted, wherein the flexible substrate has a straight portion and a wide portion having a width more than a width of the straight portion, the case member has a side wall surrounding the opening portion and forming an outer perimeter and an inner perimeter, the inner perimeter surrounding the opening portion, and a cutout portion formed in the side wall and extending from the inner perimeter to the outer perimeter to open the opening portion outwardly through the side wall, and portions of the side wall across the cutout portion are positioned outside the straight portion of the flexible substrate disposed in the opening portion.

2. The liquid ejecting head according to claim 1, wherein the portions of the side wall across the cutout portion form projecting portions projecting outside the straight portion of the flexible substrate disposed in the opening portion, and a length from a bonding surface of the liquid ejection unit, on which the case member is bonded, to a boundary between the straight portion and the wide portion is more than a height of the projecting portions from the bonding surface.

3. The liquid ejecting head according to claim 2, wherein a length of the straight portion of the flexible substrate is less than a thickness of the case member.

4. A liquid ejecting apparatus comprising the liquid ejecting head according to claim 3.

5. A liquid ejecting apparatus comprising the liquid ejecting head according to claim 2.

6. The liquid ejecting head according to claim 1, wherein a width of the cutout portion is more than a width of the straight portion of the flexible substrate.

7. The liquid ejecting head according to claim 1, wherein the case member is a rectangular substrate having long sides and short sides, and the flexible substrate is disposed in the opening portion along the short sides of the case member.

8. The liquid ejecting head according to claim 1, wherein the case member is a rectangular substrate having long sides and short sides, and the flexible substrate is disposed in the opening portion along the long sides of the case member.

9. A liquid ejecting apparatus comprising the liquid ejecting head according to claim 6.

10. A liquid ejecting apparatus comprising the liquid ejecting head according to claim 8.

11. The liquid ejecting head according to claim 1, wherein the opening portion of the case member overlaps a center of the case member in plan view.

12. A liquid ejecting apparatus comprising the liquid ejecting head according to claim 11.

13. The liquid ejecting head according to claim 8, wherein the wide portion of the flexible substrate has a width increasing from the straight portion toward one end portion in a width direction.

14. The liquid ejecting head according to claim 7, wherein the opening portion of the case member does not overlap a center of the case member in plan view.

15. The liquid ejecting head according to claim 7, wherein the opening portion has a width more than a width of the straight portion of the flexible substrate, and a gap from an end portion of the straight portion disposed in the opening portion to an end portion of the opening portion has a length less than a distance from the end portion of the straight portion to an end portion of the wide portion.

16. The liquid ejecting head according to claim 7, wherein the case member has a liquid storage chamber along the long sides of the case member, the flexible substrate is disposed in the case member along the short sides of the case member, and an area of the case member in which the flexible substrate is disposed is positioned outside an area of the case member in which the liquid storage chamber is formed.

17. The liquid ejecting head according to claim 7, wherein the cutout portion is formed in a portion of the side wall of one of the short sides of the case member, the opening portion is formed along the short sides of the case member, and the cutout portion has a width more than the width of the straight portion of the flexible substrate.

18. The liquid ejecting head according to claim 7, wherein a height of the projecting portions from a bonding surface, on which the case member is bonded, of the liquid ejection unit is less than a thickness of the case member.

19. The liquid ejecting head according to claim 18, wherein the wide portion of the flexible substrate has an inclined portion inclined to have a width gradually increasing from the straight portion, and a surface of the projecting portions opposing the wide portion has an inclined surface inclined in accordance with inclination of the inclined portion of the wide portion.

20. A liquid ejecting apparatus comprising the liquid ejecting head according to claim 1.

* * * * *